US006047878A

United States Patent [19]

Lowry

[11] Patent Number: 6,047,878

[45] Date of Patent: Apr. 11, 2000

[54] SUBSTANTIALLY PAPER CONTAINER

[75] Inventor: James W. Lowry, Florence, S.C.

[73] Assignee: Sonoco Development, Inc., Hartsville, S.C.

[21] Appl. No.: 09/266,301

[22] Filed: Mar. 11, 1999

[51] Int. Cl.[7] ..... B65D 3/10

[52] U.S. Cl. ..... 229/5.5; 229/125.09; 229/247; 229/123.1; 229/125.05; 220/256; 220/276; 220/359.3

[58] Field of Search ..... 220/256, 276, 220/359.3; 229/125.09, 5.5, 247, 123.1, 125.05

[56] References Cited

U.S. PATENT DOCUMENTS

| | | | |
|---|---|---|---|
| 1,803,239 | 4/1931 | Deane | 229/5.5 |
| 1,961,556 | 6/1934 | Fallows . | |
| 1,961,559 | 6/1934 | Herrmann . | |
| 1,961,560 | 6/1934 | Herrmann . | |
| 1,963,994 | 6/1934 | Herrmann . | |
| 1,967,931 | 7/1934 | Fox . | |
| 2,009,539 | 7/1935 | Wootton . | |
| 2,033,724 | 3/1936 | Marshall . | |
| 2,053,726 | 9/1936 | Marshall . | |
| 2,094,241 | 9/1937 | Herrmann . | |
| 2,110,616 | 3/1938 | Wilcox | 229/5.5 |
| 2,112,571 | 3/1938 | Marshall . | |
| 2,118,591 | 5/1938 | Clark | 229/5.5 |
| 2,120,898 | 6/1938 | Moore . | |
| 2,146,226 | 2/1939 | Punte | 229/125.09 X |
| 2,152,400 | 3/1939 | Rold . | |
| 2,522,058 | 9/1950 | Peters | 229/5.5 |
| 2,582,541 | 1/1952 | Harrison | 229/5.5 |
| 2,623,681 | 12/1952 | Wilcox . | |
| 2,970,736 | 2/1961 | Baughan | 229/123.1 |
| 3,285,496 | 11/1966 | Barnhardt, Sr. et al. . | |
| 3,437,257 | 4/1969 | Bua | 229/123.1 |
| 3,973,719 | 8/1976 | Johnson et al. . | |
| 4,556,166 | 12/1985 | Penttila . | |
| 4,557,414 | 12/1985 | Ford et al. . | |
| 4,606,462 | 8/1986 | Bogren . | |
| 5,566,629 | 10/1996 | Sireix . | |

*Primary Examiner*—Stephen P. Garbe
*Assistant Examiner*—Tri M. Mai
*Attorney, Agent, or Firm*—Alston & Bird LLP

[57] ABSTRACT

A substantially paper container has a top end closure adapted to be removed for opening the container and repositioned for closing the container. The container includes a tubular body of substantially paper material, a cup-shaped end closure of substantially paper material and a cup-shaped membrane having an outer upwardly-extending rim portion of substantially the same height as an upwardly-extending rim portion of the cup-shaped end closure. The membrane and end closure are positioned in an open upper end portion of the body in superimposed relationship with the membrane below the end closure. An upper area of the upper end portion of the body extends above the superimposed rim portions of the membrane and the end closure and is folded inwardly over and around the upper ends of the superimposed rim portions. Bonds, preferably heat-sealed bonds, are formed between an outside surface of the membrane rim portion and an inside surface of the body and between an inside surface of the end closure rim portion and the inside surface of the folded-over upper end of the body. A cut extends circumferentially of the upper end portion of the body and extends inwardly through the body and the membrane rim portion, but not through the end closure rim portion, so that the end closure with the folded-over body upper end portion and the membrane rim portion, which are above the cut, can be removed from and replaced in the body upper end portion.

9 Claims, 3 Drawing Sheets

SUBSTANTIALLY PAPER CONTAINER

FIELD OF THE INVENTION

This invention relates to a substantially paper container having a top end closure adapted to be removed for opening the container to dispense some of the product contained therein and repositioned for closing the container to store the remaining product therein.

BACKGROUND OF THE INVENTION

Heretofore, containers utilized primarily for dry food and powdered products were constructed of a composite tubular (cylindrical and noncylindrical) body member which was substantially constructed of paper material and end closure members for closing opposed open ends of the body member and which were usually constructed of metal or plastic material. Because of the expense of constructing a container having different materials for one or both of the end closures from the tubular body member and because recycling of the entire container was difficult when made of multiple materials, there is a need to have a container which is substantially of all paper material and which includes both a tubular body member and end closure members which are constructed substantially of paper material. While attempts have been made to produce containers having the tubular body member and the end closures of substantially paper material, these prior container constructions were costly to produce and the construction thereof made it difficult to provide a satisfactory container which had a top end closure adapted to be removed for opening the container to dispense some of the product contained therein and repositioned for closing the container to store remaining product therein.

OBJECT AND SUMMARY OF THE INVENTION

Accordingly, it is the object of this invention to provide an improved container constructed substantially of paper material and having a top end closure adapted to be removed and repositioned. It has been found by this invention that the above object may be accomplished by providing a container having generally the following construction.

A tubular body member is constructed of substantially paper material and has inside and outside surfaces and open upper and lower opposed end portions. A cup-shaped end closure member is constructed of substantially paper material and has outer and inner surfaces and defines a generally flat center portion and an outer upwardly-extending rim portion of predetermined height which surrounds the center portion. A cup-shaped membrane member has outer and inner surfaces and defines a generally flat center portion and an outer upwardly-extending rim portion of predetermined height, which is substantially equal to the height of the end closure rim portion, and surrounds the center portion.

The cup-shaped membrane member and the cup-shaped end closure member are positioned in the open upper end portion of the body member in superimposed relation with the membrane member below the end closure member. The inside surface of the membrane member is adjacent to the outside surface of the end closure member along substantially the entire height of the rim portions and the outside surface of the membrane member rim portion contacts the inside surface of the body member. An upper area of the upper end portion of the body member extends upwardly above the superimposed rim portions of the membrane member and the end closure member and is folded inwardly over and around the upper ends of the superimposed rim portions so that the inside surface of the folded-over upper end of the body member is in contact with the inside surface of the end closure member rim portion. Bonds are formed between the outside surface of the membrane member rim portion and the inside surface of the body member and between the inside surface of the end closure rim portion and the inside surface of the folded-over upper end of the body member. A cut extends circumferentially and at least substantially around the upper end portion of the body member and extends inwardly through the body member and the membrane member rim portion, but not through the end closure member rim portion. With this construction, the end closure member with the folded-over body member upper end portion and the membrane member rim portion above the cut can be removed from and replaced in the body member upper end portion below the cut.

Preferably, a pull tab member is provided for aiding in removing the membrane from the upper end portion of the body member of the container after removal of the end closure member. The pull tab member is in the form of a strip of material positioned over a part only of the top surface of the center portion and the rim portion of the membrane member. A bond is provided between a lower surface of the pull tab member and the inner surface of the rim portion of the membrane member so that the pull tab can be easily grasped. The bond between the pull tab member and the membrane member is preferably stronger than the bond between the membrane member and the container body member, so that pulling of the pull tab will cause rupture of the bond between the membrane member and the container body member.

The cut is preferably defined by a bottom inwardly-creased edge in the body member to aid in controlling the fit between the end closure member and the body member during removal and replacement of the end closure member in the body member. It is also preferable that an area of the folded-over body member upper end portion which is positioned inside the cup-shaped end closure member includes an outwardly contoured shape to facilitate gripping thereof when removing the end closure member from the container body member.

BRIEF DESCRIPTION OF THE DRAWINGS

Some of the objects and advantages of this invention have been described above, other objects and advantages will appear in the detailed description of preferred embodiments of the invention to be described below, when taken in conjunction with the accompanying drawings, in which.

DETAILED DESCRIPTION OF PREFERRED EMBODIMENTS OF THE INVENTION

Figure 1:
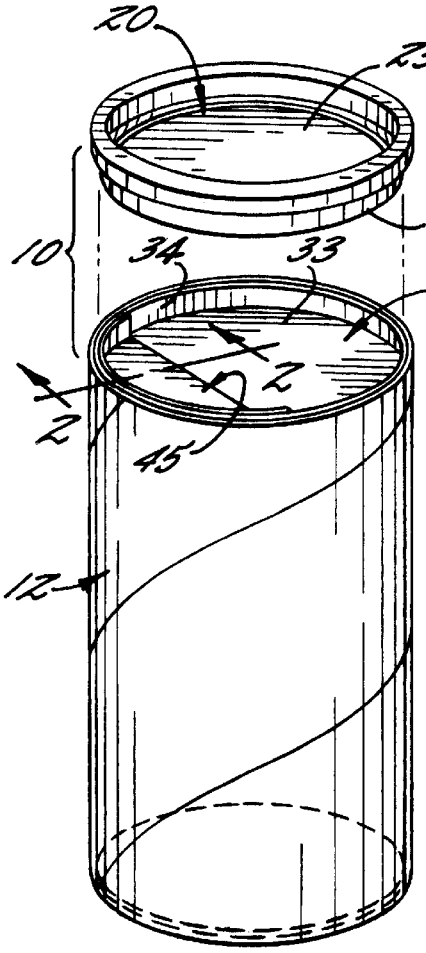
FIG. 1 is a perspective view of a container constructed in accordance with this invention and showing the top end closure member thereof removed or exploded.
Figure 2:
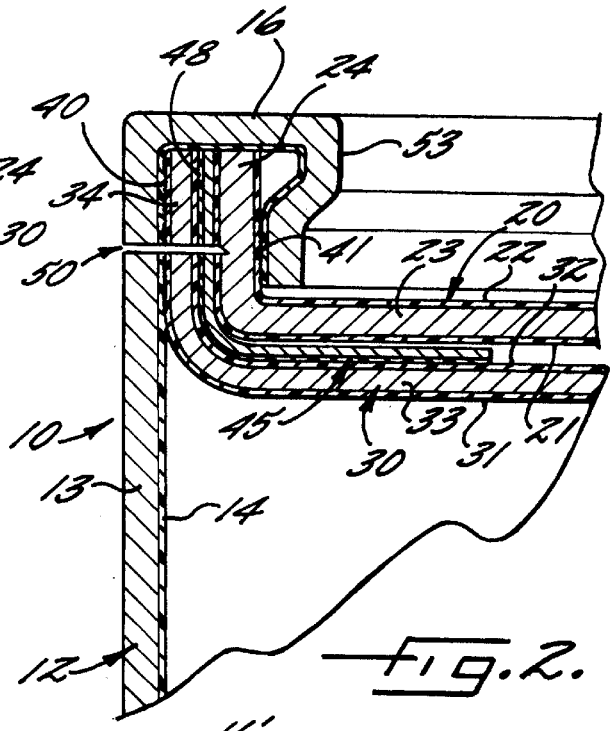
FIG. 2 is an enlarged partial sectional view, taken generally along the line 2—2 of FIG. 1 with the top end closure member in position in the container.
Figure 3:
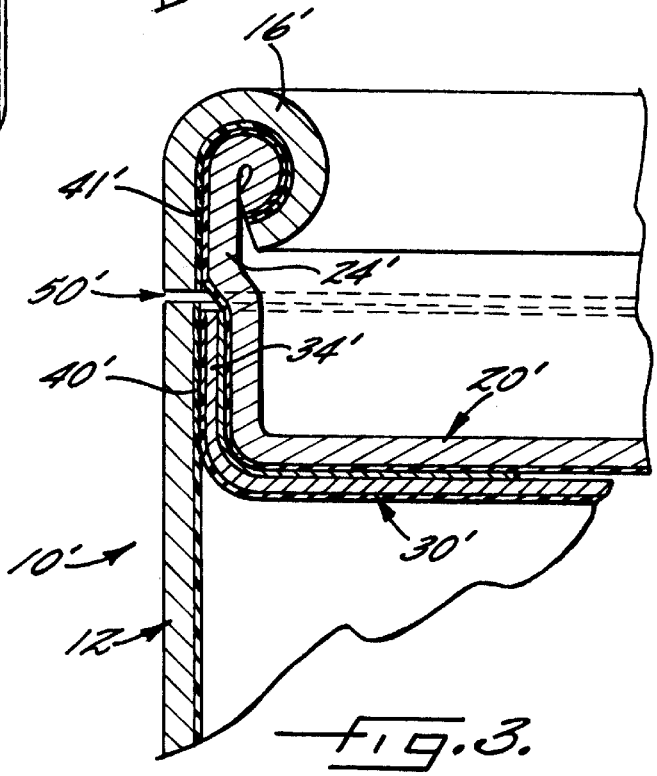
Fig. 3. (PRIOR ART)
FIG. 3 is a view, like FIG. 2, of a prior art container to illustrate the difference in construction of the container of this invention and the prior art.

Referring now to the drawings, FIGS. 1, 2 and 4–8 illustrate a preferred embodiment of this invention and FIG. 3 illustrates a prior art construction. As shown in FIGS. 1, 2 and 4–8, a substantially paper container, generally indicated at 10, includes the following construction.

A tubular body member 12 having outside and inside surfaces 13, 14 and upper and lower opposed end portions is formed of any desired shape, e.g. cylindrical or non-cylindrical, and may be spirally wound, convolutely wound, linearly drawn or otherwise constructed. The body member 12 is of substantially paper material and preferably comprises a composite material including (as shown on FIG. 7) a layer of paperboard material 15 and an inside liner layer 16 which includes a heat-sealing film material forming the inside surface 14 of the tubular body member 12. The paperboard material 15 may be any conventional paperboard or board stock used in constructing this type of body member 12 and having a thickness of between 0.010 and about 0.035 inch, preferably between about 0.015 and 0.030 inch, for example 0.021 inch. The board stock conventionally used in manufacture of spirally-wound containers is commercially available from various manufacturers including Sonoco Products Company, Republic Paperboard Corporation and Middletown Board Corporation. In order to function advantageously in the body member 12, the board stock typically is composed of Kraft or recycled paper and can range from e.g. 50 to 100 lbs./ream. In some instances the board stock can include a weak exterior layer, e.g. a 0.003 inch news exterior. The liner layer 16 is conventionally spirally-wound inside the paperboard material layer 15 when the tubular body member 12 is spirally-wound or is otherwise positioned inside the paperboard material layer 15 when the tubular body member 12 is otherwise constructed and may advantageously be a barrier type, flexible sheet material, such as a polymer/foil, a Kraft/foil/polymer, a polymer/polymer, or a Kraft/foil laminate having an inside polycoated layer forming the inside surface 14 which is heat sealing in the tubular body member 12. The container may also include a label layer (not shown), if desired.

Figure 7:
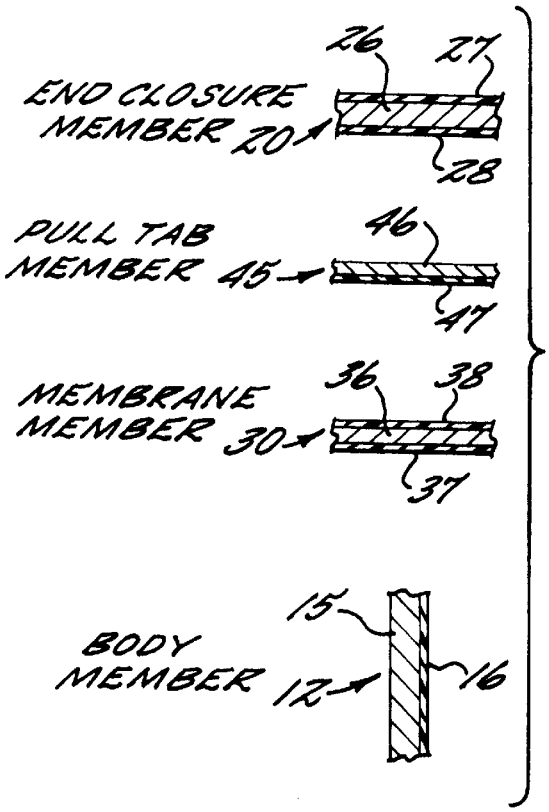
FIG. 7 is a schematic view illustrating the various layers of material utilized for the various component members of the container.

The container 10 further includes a cup-shaped end closure member 20 of substantially paper material and having outer and inner surfaces 21, 22 and defining a generally flat center portion 23 and an outer upwardly-extending rim portion 24 of predetermined height and surrounding the center portion 23. The cup-shaped end closure member 20 is preferably constructed (as shown in FIG. 7) of a composite material which may include a layer of paperboard material 26 and a layer of heat sealing film material 27 forming the inside surface 22 of the end closure member 20. The composite material forming the end closure member 20 may also include a layer 28 forming the outside surface 22 thereof which may be of the same material as the liner layer 16 of the tubular body member 12, as described above. The paperboard material 26 utilized in the end closure 20 may be constructed of the same paperboard material as utilized for the layer 15 of the tubular body member 12, as described above. The heat sealing film layer 27 forming the inside surface 21 of the end closure member 20 may be any suitable heat sealing polymer or paper coated polymer.

The container 10 further includes a cup-shaped membrane member 30 having outer and inner surfaces 31, 32 and defining a generally flat center portion 33 and an outer upwardly-extending rim portion 34 surrounding the center portion 33. The membrane member rim portion 34 is of a predetermined height substantially equal to the height of the end closure member rim portion 24.(as shown in FIG. 2). This membrane member 30 (as shown in FIG. 7) is preferably constructed of a composite or coextruded material which could include a heat sealing film/barrier if needed 37, a substrate 36 and material to give it strength and heat sealing coating 38. An example of the membrane 30 could be a coextruded blend of LDPE and EMA/MET PET/LDPE.

The cup-shaped membrane member 30 and the cup-shaped end closure member 20 are positioned in the open upper end portion of the body member 12 (as shown in FIG. 2) in superimposed relation with the membrane member 30 below the end closure member 20 and having the inside surface 32 of the membrane member 30 adjacent to the outside surface 21 of the end closure member 20 along substantially the full height of the rim portions 24, 34 and having the outside surface 31 of the membrane member 30 contacting the inside surface 14 of the body member 12.

An upper area 18 of the upper end portion of the body member 12 extends upwardly above the superimposed rim portions 24, 34 of the end closure member 20 and the membrane member 30 and is folded inwardly over and around the upper ends of these rim portions 24, 34 so that the inside surface 14 of the folded-over upper end 18 of the body member 12 is in contact with the inside surface 22 of the end closure member rim portion 24. A bond 40 is formed between the outside surface 31 of the membrane member rim portion 34 and the inside surface 14 of the body member 12 (as shown in FIG. 2). A bond 41 is also formed between the inside surface 22 of the end closure member rim portion 24 and the inside surface 14 of the folded-over upper end 18 of the body member 12 (as shown in FIG. 2). These bonds 40, 41 are preferably heat seals formed between heat-sealing layers 16 of the body member 12 and heat-sealing layer 37 of the membrane member 30 and between the heat-sealing layer 16 of the body member 12 and the heat-sealing layer 27 of the end closure member 20.

The membrane member 30 may further include a pull tab member 45 for aiding in removing the membrane member 30 from the upper portion of the body member 12 of the container 10. The pull tab member 45 (as shown in FIG. 7) may be constructed of a strip of composite material including a suitable substrate layer 46 which may be PET and a layer of heat-sealing film material 47 which may be LDPE and which forms a lower surface of the pull tab member 45. The pull tab member 45 may also include a material layer to give the tab rigidity and which may be machine grade Kraft paper. The pull tab member 45 is positioned over a part only of the top surface of the center portion 33 and the rim portion 34 of the membrane member 30 (as shown in FIG. 1) with the heat-sealing film material 47 forming the inside surface in contact therewith A bond 48, which may be in the form of a heat seal, adhesive or a combination thereof, is formed between the pull tab member 45 and the rim portion 34 of the membrane member 30. This bond 48 is stronger than the bond 40 between the membrane member 30 the container body member 12 so that pulling of the pull tab member 45 will cause rupture of the bond 40 between the membrane member 30 and the container body 12 when it is desired to remove the membrane member.

Figure 4:
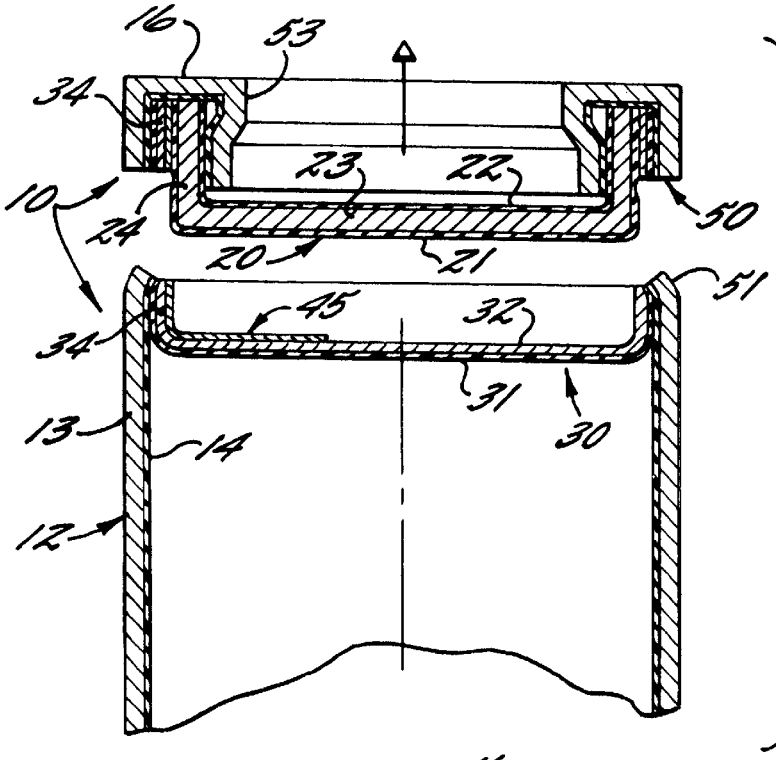
FIG. 4 is an enlarged partial sectional view through the container of FIG. 1 and illustrating the top end closure member removed or exploded from the container.
Figure 6:
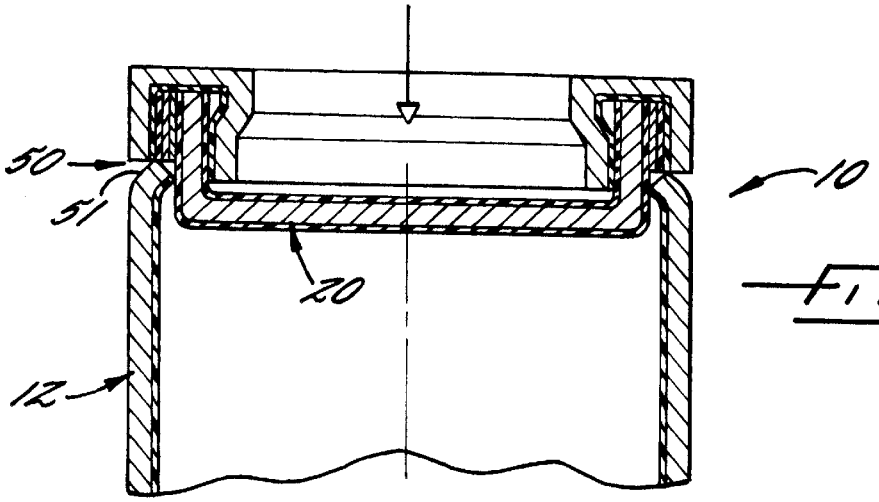
FIG. 6 is a view, like FIG. 4, with the top end closure member repositioned in the container after removal of the membrane member.

A cut 50 extends circumferentially and substantially around the upper end portion of the body member 12 and extends inwardly through the body member 12 and the membrane member rim portion 34 and the pull tab member 45, but not through the rim portion 24 of the end closure member 20, so that the end closure member 20 with the folded-over body member upper end portion 18 and the membrane member rim portion 34 and pull tab member 45 above the cut 50 can be removed from the upper end portion of the body member 12 (as shown in FIG. 4) and replaced in the upper end portion of the body member 12 below the cut 50 (as shown in FIG. 6).

Figure 5:
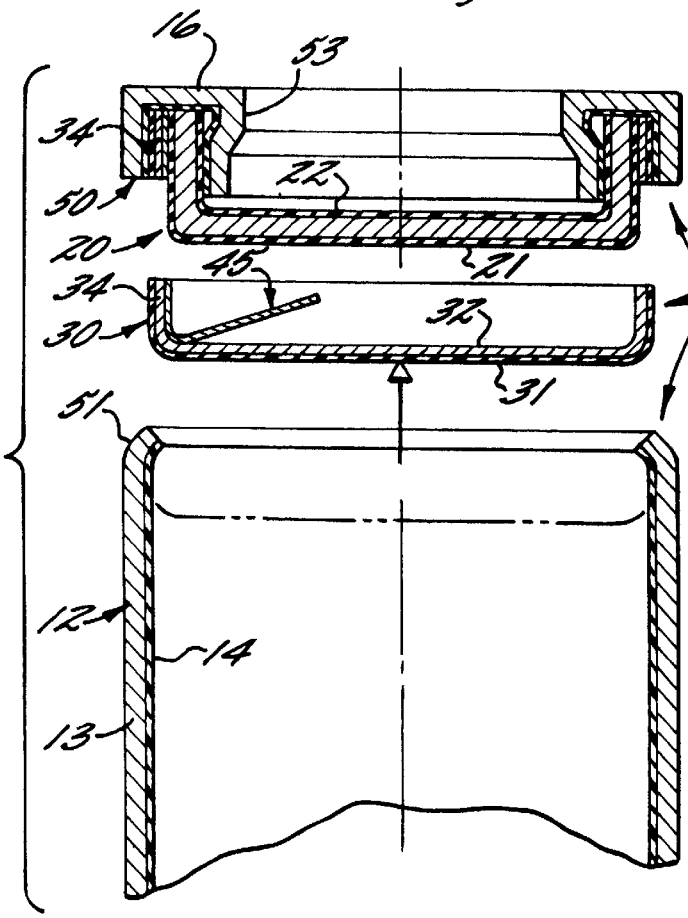
FIG. 5 is a view, like FIG. 4, with the membrane member of the container also removed or exploded therefrom.

The cut 50 may preferably be defined by a bottom inwardly-creased edge 51 in the body member 12 (as shown in FIGS. 4–6) to aid in controlling the fit between the end closure member 20 during removal and replacement of the end closure member 20 in the body member 12. An area 53 of the folded-over body member upper end 18 which is positioned inside the cup-shaped end closure member 20 may include an outwardly contoured shape (as shown in FIG. 2) to facilitate gripping thereof when removing said end closure member from said end closure member 20 from said container body member 12.

Figure 8:
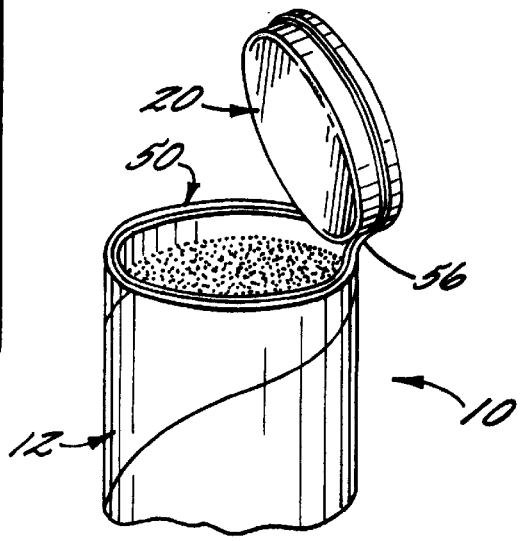
FIG. 8 is a partial perspective view of a container having a flap or hinged portion connecting the top end closure member to the container after removal from the top end portion thereof.

As shown in FIG. 8, the cut 50 may extend only partially around the upper end portion of the body member 12 to leave a small uncut circumferentially extending portion defining a flap 56 to allow the end closure member 20 to be removed from the body member 12 and remain partially attached thereto by the flap 56 for ease in removal and replacement of the end closure member 20 in the body member 12 after the membrane member 30 has been removed and product has been dispensed from the container 10. The cut 50 may also, of course, extend all the way around the body member 12 to allow complete removal of the end closure member 20 (as shown in FIG. 1).

With the above construction of the substantially paper container 10, the container may be opened for dispensing product contained therein by grasping the contoured portion 53 of the folded-over upper end portion 18 of the body member 12 which is above the cut 50 and lifting the end closure 20 with the folded-over body member upper end portion 18 and the membrane rim portion 34 and pull tab member 45 (which extend above the cut 50) out of the upper end portion of the body member 12 (as shown in FIG. 4). The membrane member 30 may then be removed from the remaining upper end portion of the body member 12 by grasping the pull tab 45 and breaking the bond 40 between the membrane rim portion 34 and the body member 12. With the membrane member 30 removed (as shown in FIG. 5), some of the contents of the container 10 may be dispensed. The end closure member 20 with the folded-over body member upper end portions 16 and the membrane rim portion 34 and pull tab member 45 above the cut 50 may then be repositioned into the upper end portion of the tubular body member 12 for reclosing the container 10 (as shown in FIG. 6).

This improved substantially paper container construction 10 is an improvement over the closest known prior art substantially paper container (disclosed in U.S. Pat. No. 5,566,529 which issued on Oct. 22, 1996) which is shown in FIG. 3 and wherein like reference numerals with prime notations are utilized for similar parts. The rim portion 24' of the end closure member 20' extends substantially above the rim portion 34' of the membrane member 30' so that the bond 41' may be formed between an outside surface of the end closure rim portion 24' and the inside surface of the body member 12' and a bond 40' may be formed between the outside surface of the membrane member rim portion 34' and the inside surface of the body member 12'. If the rim portions 24', 34' of the end closure member and the membrane member 20', 30' were of equal height, these bonds 40', 41' along the outside surfaces of these rim portions could not be accomplished. Also, the cut 50' which allows removal of the end closure member 20' from the body member 12' must be positioned in an area between the bonds 40' and 41'. This prior art construction of a container 10' created manufacturing tolerance problems in location of these bonds 40', 41' and the cut 50'. The improved container construction 10 of the present invention overcomes this problem by the location of the bonds 40, 41 and the cut 50, as described above. Also, the container construction 10 of the present invention includes other features not present in the prior art container 10', as also discussed above.

The invention has been described in considerable detail with reference to its preferred embodiment. However, variations and modifications can be made within the spirit and scope of the invention, as described in the foregoing specification and as defined in the following claims.

What is claimed is:

1. A substantially paper container having a top end closure adapted to be removed for opening the container to dispense some of product contained therein and repositioned for closing the container to store the remaining product therein, said container comprising:

a tubular body member of substantially paper material and having inside and outside surfaces and open upper and lower opposed end portions;

a cup-shaped end closure member of substantially paper material and having outer and inner surfaces and defining a generally flat center portion and an outer upwardly-extending rim portion of predetermined height and surrounding said center portion;

a cup-shaped membrane member having outer and inner surfaces and defining a generally flat center portion and an outer upwardly-extending rim portion of predetermined height substantially equal to said height of said end closure member rim portion and surrounding said center portion;

said cup-shaped membrane member and said cup-shaped end closure member being positioned in said open upper end portion of said body member in superimposed relation with said membrane member below said end closure member and having said inside surface of said membrane member adjacent said outside surface of said end closure member along substantially the height of said rim portions and having said outside surface of said membrane member rim portion contacting said inside surface of said body member;

an upper area of said upper end portion of said body member extending upwardly above said superimposed rim portions of said membrane member and said end closure member and being folded inwardly over and around upper ends of said superimpose rim portions so that said inside surface of said folded-over upper end of said body member is in contact with said inside surface of said end closure member rim portion;

bonds between said outside surface of said membrane member rim portion and said inside surface of said body member and between said inside surface of said end closure member rim portion and said inside surface said folded-over upper end of said body member; and a cut extending circumferentially and substantially around said upper end portion of said body member and extending inwardly through said body member and said membrane member rim portion, but not through said end closure member rim portion, so that said end closure member with said folded-over body member upper end portion and said membrane member rim portion above said cut can be removed from and replaced in said body member upper end portion below said cut.

2. A substantially paper container, as set forth in claim 1, further including a pull tab member for aiding in removing of said membrane member from said upper end position of said body member of said container; said pull tab member comprising a strip of material positioned over a part only of said top surface of said center portion and said rim portion of said membrane member, and a bond between a lower surface of said pull tab member and said inner surface of said rim portion of said membrane member.

3. A substantially paper container, as set forth in claim 2, in which said bond between said pull tab member and said membrane member is stronger than said bond between said membrane member and said container body member, so that pulling of said pull tab will cause rupture of said bond between said membrane member and said container body member.

4. A substantially paper container, as set forth in claim 1, 2 or 3, in which said bonds are heat seals.

5. A substantially paper container, as set forth in claim 4, in which said tubular body member is constructed of a composite material including a layer of paperboard material and a layer of heat sealing film material forming said inside surface thereof; said cup-shaped membrane member is constructed of a composite material including a substrate layer and a layer of heat-sealing film material forming said outside surface thereof; and said cup-shaped end closure member is constructed of a composite material including a layer of paperboard material and a layer of heat sealing film material forming said inside surface thereof.

6. A substantially paper container, as set forth in claim 1, in which said cut is defined by a bottom inwardly-creased edge in said body member to aid in controlling the fit between said end closure member and said body member during removal and replacement of said end closure member in said body member.

7. A substantially paper container, as set forth in claim 1, in which an area of said folded-over body member upper end positioned inside said cup-shaped end closure member includes an outwardly contoured shape to facilitate gripping thereof when removing said end closure member from said container body member.

8. A substantially paper container having a top end closure adapted to be removed for opening the container to dispense some of the product contained therein and repositioned for closing the container to store the remaining product therein, said container comprising:

a tubular body member having inside and outside surfaces and open upper and lower opposed end portions, said tubular body member being constructed of a composite material including a layer of paperboard material and a layer of heat-sealing film material forming said inside surface thereof;

a cup-shaped end closure member having outer and inner surfaces and defining a generally flat center portion and an outer upwardly-extending rim portion of predetermined height and surrounding said center portion, said end closure member being constructed of a composite material including a layer of paperboard material and a layer of heat-sealing film material forming said inside surface thereof;

a cup-shaped membrane member having outer and inner surfaces and defining a generally flat center portion and an outer upwardly-extending rim portion of predetermined height substantially equal to said height of said end closure member rim portion and surrounding said center portion, said membrane member being constructed of a composite material including a substrate material and a layer of heat-sealing film material forming said outside surface thereof;

said cup-shaped membrane member and said cup-shaped end closure member being positioned in said open upper end portion of said body member in superimposed relation with said membrane member below said end closure member and having said inside surface of said membrane member adjacent said outside surface of said closure member along substantially the height of said rim portions and having said outside heat-sealing surface of said membrane member rim portion contacting said inside heat-sealing surface of said body portion;

an upper area of said upper portion of said body member extending upwardly above said superimposed rim portions of said membrane member and said end closure member and being folded inwardly over and around upper ends of said superimposed rim portions so that said inside heat-sealing surface of said folded-over upper end of said body member is in contact with said inside heat-sealing surface of said end closure member rim portion;

heat seal bonds between said outside heat-sealing surface of said membrane rim portion and said inside heat-sealing surface of said body member and between said inside heat-sealing surface of said end closure member rim portion and said inside heat-sealing surface of said folded-over upper end of said body member;

a cut extending circumferentially and substantially around said upper end portion of said body member and extending inwardly through said body member and said membrane member rim portion, but not through said end closure member rim portion, so that said end closure with said folded-over body member upper end portion and said membrane member rim portion above said cut can be removed from and replaced in said body member upper end portion below said cut, said cut is defined by a bottom inwardly-creased edge in said body member to aid in controlling the fit between said end closure member and said body member during removal and replacement of said end closure member in said body member;

a pull tab member for aiding in removing of said membrane member from said upper end portion of said body member of said container, said pull tab member being constructed of a composite material including a substrate layer and a layer of heat-sealing film material forming a lower surface thereof, said pull tab member being positioned over a part only of said inside surface of said center portion and said rim portion of said membrane member with said heat sealing film material in contact therewith, and a heat seal bond between said pull tab member and said membrane member which is stronger than said bond between said membrane member and said container body member so that pulling of said pull tab will cause rupture of said bond between said membrane member and said container body member; and an area of said folded-over body member upper end which is positioned inside said cup-shaped end closure member includes an outwardly contoured shape to facilitate gripping thereof when removing said end closure from said container body.

9. A substantially paper container, as set forth in claim 1 or 8, in which said cut extends only partially around said upper end portion of said body member to leave a small uncut circumferentially extending portion defining a flap to allow said end closure member to be removed from said body member upper end portion and remain partially attached thereto by said flap for ease in removal and replacement of said end closure member in said body member upper end portion after removal of said membrane member and after product has been dispensed from said container.

* * * * *